United States Patent [19]

Yamada et al.

[11] Patent Number: 4,810,622

[45] **Date of Patent: * Mar. 7, 1989**

[54] METHOD FOR PROCESSING SILVER HALIDE PHOTOGRAPHIC MATERIAL WITH AN ALKALINE BLACK AND WHITE DEVELOPER

[75] Inventors: Minoru Yamada; Takashi Toyoda, both of Kanagawa, Japan

[73] Assignee: Fuji Photo Film, Co. Ltd., Kanagawa, Japan

[ * ] Notice: The portion of the term of this patent subsequent to Jun. 9, 2004 has been disclaimed.

[21] Appl. No.: 69,144

[22] Filed: Jul. 2, 1987

[30] Foreign Application Priority Data

Jul. 2, 1986 [JP] Japan ..... 61-154157

[51] Int. Cl.[4] ..... G03C 5/30; G03C 5/38

[52] U.S. Cl. ..... 430/420; 430/434; 430/436; 430/438; 430/464; 430/486; 430/487; 430/491; 430/493; 430/566

[58] Field of Search ..... 430/434, 420, 436, 464, 430/966, 486, 487, 491, 493, 438, 379

[56] References Cited

U.S. PATENT DOCUMENTS

| | | | |
|---|---|---|---|
| 2,605,183 | 7/1952 | Runyan | 430/446 |
| 3,708,299 | 1/1973 | Shimamura | 430/446 |
| 4,082,553 | 4/1978 | Groet | 430/505 |
| 4,089,685 | 5/1978 | Bissonette | 430/379 |
| 4,146,395 | 3/1979 | Bissonette | 430/379 |
| 4,323,642 | 4/1982 | Levinson | 430/438 |
| 4,672,025 | 6/1987 | Yamada et al. | 430/420 |
| 4,675,274 | 6/1987 | Ueda et al. | 430/407 |

FOREIGN PATENT DOCUMENTS 3139155 4/1982 Fed. Rep. of Germany .

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A method of processing a silver halide photographic material is described, comprising developing an exposed silver halide photographic material with an alkaline black-and-white developer having a pH value of 9.2 to 10 comprising:

(1) at least one of hydroquinones, (2) at least one of 3-pyrazolidone-based developing agents, (3) at least one of dialdehyde-based hardening agents, (4) at least one antifoggant selected from the group consisting essentially of indazole-, benzimidazole-, benztriazole- and mercaptothiadiazole-based antifoggants, (5) at least one compound selected from the group consisting essentially of diethylenetriaminepentaacetic acid, triethylenetetraminehexaacetic acid, 1,3-diamino-2-propanoltetraacetic acid, ethylenediaminetetramethylenephosphonic acid, aminotrimethylenephosphonic acid and alkali metal salts thereof, (6) at least one of silver halide solvents, and (7) at least one compound selected from the group consisting essentially of sulfite, bisulfite, and metabisulfite.

5 Claims, No Drawings

METHOD FOR PROCESSING SILVER HALIDE PHOTOGRAPHIC MATERIAL WITH AN ALKALINE BLACK AND WHITE DEVELOPER

FIELD OF THE INVENTION

The present invention relates to a method for photographically processing a silver halide photographic material. More particularly, it is concerned with a method for processing a silver halide photographic material with a photographic processing solution which has greatly improved stability and provides excellent photographic characteristics.

BACKGROUND OF THE INVENTION

A black-and-white developer which is used for processing silver halide photographic materials contains dihydroxybenzenes, 3-pyrazolidones or p-aminophenols as a developing agent, an alkali agent and a sulfurous acid salt as the basic components.

Photographic characteristics required for silver halide photographic materials, particularly black-and-white negative light-sensitive materials for cameras, include sensitivity, gradation and granularity. These characteristics are required to be enhanced. Thus, naturally, the components of a developer for use in photographic processing of silver halide photographic materials are limited.

In the case of silver halide photographic materials for news photographs and publications which must be processed relatively rapidly by the use of an automatic developing machine, the material is made relatively soft so as to impart sensitization suitability due to the controlling of developing time of the material. Such relatively soft light-sensitive materials, however, have disadvantages in that the mechanical strength during processing is not sufficiently high and the drying speed is seriously lowered. To solve these problems, it becomes necessary to harden the light-sensitive material. That is, it is established practice at the present time that a dialdehyde-based hardening agent is added to a processing solution (i.e., a developer). In addition, developing hardening acts to accelerate rinsing of the light-sensitive material which has been developed and fixed. Thus, increased developing hardening is desired.

For the developing hardening reaction to proceed sufficiently, it is desirable for the developer to have a high pH value beyond the specified level. In the processing of light-sensitive materials such as an X-ray photographic material in which high contrast and high image density are needed, no problem arises in increasing developing activity by increasing the pH value of the developer. On the other hand, in the processing of general light-sensitive materials, particularly the black-and-white negative light-sensitive materials for cameras in which the contrast is low and granularity is important, the necessary characteristics are not always obtained unless the pH of the developer is within a relatively low range in view of developing activity.

However, in the pH range designed for the hardening reaction, deterioration due to oxidation is serious because the pH value is higher than that of a developer used in the developing processing not using an automatic developing machine (e.g., conventional tank development or plate development) and, furthermore, the developer is stirred in a developer tank of the automatic developing machine. Thus, the stability of the developer becomes more important. At present, however, a developer having sufficiently high stability has not been obtained.

Furthermore, in the pH range of the developer in which the hardening reaction occurs, it is difficult to balance fog and sensitivity and also to balance toe sensitivity and gradation, and a completely different technique is needed, unlike a developer for tank development which does not contain any hardening agent.

SUMMARY OF THE INVENTION

An object of the present invention is to provide a method for processing with a developer which provides excellent photographic characteristics such as sensitivity, gradation and granularity in the development of light-sensitive materials by the use of an automatic developing machine.

Another object of the present invention is to provide a method for processing with a developer which maintains the mechanical strength of a light-sensitive material at a sufficiently high level during the developing process, and contains components readily removable by washing with water, and further, which can be sufficiently dried within a specified time.

Further object of the present invention is to provide a method for processing with a stable developer which is not decreased in photographic characteristics even if stored in a replenishing tank, or even if allowed to stand in an automatic developing machine during the photographic processing, or prior to the start of the processing, or during a period for which the processing is stopped.

Still another object of the present invention is to provide a method for processing with a developer which is well balanced in fog and sensitivity, and which can hold a fog preventing action.

As a result of extensive investigations, it has now been found that the above objects can be attained by a method for processing a silver halide photographic material, which comprises developing an imagewise exposed silver halide photographic material with an alkaline black-and-white developer having a pH value of 9.2 to 10 comprising:

(1) At least one of hydroquinones;

(2) At least 3-pyrazolidone-based developing agents;

(3) At least one of dialdehyde-based hardening agents;

(4) At least one antifoggant selected from the group consisting essentially of an indazole-based anti-foggant, a benzimidazole-based antifoggant, a benztriazole-based antifoggant, and a mercaptothiadiazole-based anti-foggant;

(5) At least one compound selected from the group consisting essentially of diethylenetriaminepentaacetic acid, triethylenetetraminehexaacetic acid, 1,3-diamino-2-propanoltetraacetic acid, ethylenediaminetetramethylenephosphonic acid, aminotrimethylenephosphonic acid and alkali metal salts thereof;

(6) At least one of silver halide solvents; and (7) At least one compound selected from the group consisting essentially of sulfite, bisulfite, and metabisulfite.

DETAILED DESCRIPTION OF THE INVENTION

The above components (1) to (5) are components already known in automatic development of X-ray photographic materials, for example, as described in Japanese patent application (OPI) No. 36744/86 (the term "OPI" as used herein refers to a "published unexamined Japanese patent application"). In an X-ray photographic developer, however, as described above, the pH is generally high in order to obtain high density and high gradation. Thus, it is apparent that the requirement in the present developer that the pH is not more than 10 is different from that in the X-ray photographic developer.

The silver halide solvents (for example, thiosulfuric acid salts such as sodium thiosulfate and ammonium thiosulfate; ammonium salts such as ammonium chloride; thiocyanic acid salts (Rhodanates) such as potassium thiocyanate, ammonium thiocyanate and sodium thiocyanate; organic amines described in U.S. Pat. Nos. 2,196,037, 2,496,903, 2,515,147, 2,541,889, 2,482,546 and 2,605,183; imidazole compounds such as 2-methylimidazole described in U.S. Pat. No. 3,708,299; and thioether compounds described in Japanese Patent Application (OPI) No. 63530/82) which are to be used in the present invention are well known. However, the use of the composition comprising the above components (1) to (7) at a pH of not more than 10 has not been known.

The components of the alkaline black-and-white developer to be used in the present invention will hereinafter be explained in detail.

Hydroquinones which are used in the present invention include hydroquinone, chlorohydroquinone and methylhydroquinone. Particularly preferred is hydroquinone. The amount of the hydroquinones added is 1 to 10 g, preferably 2 to 8 g, per liter of the developer.

3-Pyrazolidone-base developing agents which are used in the present invention include 1-phenyl-3-pyrazolidone, 1-phenyl-4-methyl-3-pyrazolidone, 1-phenyl-4,4'-dimethyl-3-pyrazolidone, 1-phenyl-4-ethyl-3-pyrazolidone, 1-phenyl-5-methyl-3-pyrazolidone, 1-phenyl-4-methyl-4-hydroxymethyl-3-pyrazolidone, and 1-phenyl-4,4-dihydroxymethyl-3-pyrazolidone. Of these 3-pyrazolidone-based developing agents, preferred are 1-phenyl-3-pyrazolidone, 1-phenyl-4-methyl-4-hydroxymethyl-3-pyrazolidone, and 1-phenyl-4,4-dihydroxymethyl-3-pyrazolidone.

The amount of the 3-pyrazolidone-based developing agent added is generally 0.05 to 1 g, preferably 0.1 to 0.8 g, per liter of the developer.

Hardening agents which are used in the present invention include dialdehyde-based hardening agents and adducts of their bisulfite. Representative examples include glutaraldehyde, α-methylglutaraldehyde, β-methylglutaraldehyde, maleindialdehyde, succindialdehyde, methoxysuccindialdehyde, methylsuccindialdehyde, α-methoxy-β-ethoxyglutaraldehyde, α-n-butoxyglutaraldehyde, α,α-dimethoxysuccindialdehyde, β-isopropylsuccindialdehyde, α,α-diethylsuccindialdehyde, butylmaleindialdehyde and adducts of their bisulfite. Of the above compounds, glutaraldehyde and adducts of its bisulfite are most preferred.

The dialdehyde-based hardening agent can be used in such an amount that the sensitivity of the photographic layer is not decreased and the drying time is not seriously lengthened. The amount of the dialdehyde-based hardening agent used is generally 1 to 50 g, preferably 3 to 10 g, per liter of the developer.

Antifoggants which are used in the present invention include indazole-, benzimidazole-, benztriazole- and mercaptothiadiazole-based antifoggants. Representative examples include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenztriazole, sodium 4-(2-mercapto-1,3,4-thiadiazole-2-ylthio)butanesulfonate and 5-amino-1,3,4-thiadiazole-2-thiol.

Nitro group-containing antifoggants can be particularly preferably used in the present invention.

Of the above antifoggants, 5-nitroindazole, 5-nitrobenzimidazole and 5-nitrobenztriazole are preferred. In particular, 5-nitroindazole is preferred from the standpoint of safety.

The amount of the antifoggant added is usually 0.01 to 2 mmol per liter of the developer, preferably 0.02 to 1 mmol, and more preferably 0.02 to 0.5 mmol, per liter of the developer.

Compounds (5) to be used in the present invention are known as chelating agents for calcium and magnesium. Taking into consideration (i) the stability of the chelating agent itself in the alkaline developer, (ii) the influences on the stability of the antifoggant in the developer, and (iii) the influences on the stability of the hydroquinones (1) in the developer, a suitable compound is selected. Preferred examples of these chelating agents are diethylenetriaminepentaacetic acid, triethylenetetraminehexaacetic acid, 1,3-diamino-2-propanoltetraacetic acid, ethylenediaminetetramethylenephosphonic acid, aminotrimethylenephosphonic acid and alkali metal salts thereof. In particular, diethylenetriaminepentaacetic acid, triethylenetetraminehexaacetic acid, ethylenediaminetetramethylenephosphonic acid and alkali metal salts thereof are preferably used.

A suitable amount of the compound (5) to be added is $0.5\times10^{-3}$ to $2\times10^{-2}$ mol per liter of the developer and more preferably $0.5\times10^{-3}$ to $1\times10^{-2}$ mol per liter of the developer. The optimum amount varies with the properties of the processing solution. For example, in a developer containing phosphoric acid salts, it is necessary for the compound (5) to be added in a high concentration. Further, the amount of the compound (5) to be added varies with the quality of water to be used in the processing. In a case where water of high hardness is used, it is necessary to increase the amount of the compound (5) added.

Silver halide solvents which are used in the present invention include thiosulfuric acid salts (e.g., sodium thiosulfate, potassium thiosulfate and ammonium thiosulfate), ammonium salts (e.g., ammonium chloride), thiocyanic acid salts (Rhodanate, such as potassium thiocyanate, ammonium thiocyanate and sodium thiocyanate), organic amines (e.g., organic amines as described in U.S. Pat. Nos. 2,196,037, 2,496,903, 2,515,147, 2,541,889, 2,482,546 and 2,605,183, particularly preferably tertiary amines), imidazole compounds (e.g., 2-methylimidazole as described in U.S. Pat. No. 3,708,299) and thioether compounds (e.g., thioether compounds as described in Japanese patent application (OPI) No. 63530/82), which are preferred from the standpoint of balance in sensitivity and gradation in low and high density ranges. Of these silver halide solvents, preferred are thiosulfuric acid salts, thioether compounds, and imidazole compounds.

Since the effect of the silver halide solvent varies depending on the type thereof, the amount of the silver halide solvent added varies greatly depending on the type of the silver halide solveht. The amount of the silver halide solvent added is usually 5 mg to 5 g, preferably 5 mg to 2 g, and more preferably 10 mg to 1 g, per liter of the developer.

Examples of the sulfite, bisulfite, and metabisulfite include sodium sulfite, sodium bisulfite, sodium metabisulfite, potassium sulfite, potassium bisulfite, potassium metabisulfite and ammonium sulfite.

An amount of the total sulfite ion composed of the sulfite, bisulfite, or metabisulfite which is added in the present invention is preferably not less than 40 g per liter of the developer.

When an adduct of bisulfite is used as a dialdehyde hardening agent, the amount of the adduct is calculated as that of the sulfite (7) of the present invention. The amount of the total sulfite ion ($SO_3^{2-}$) is preferably not less than 40 g, more preferably 40 to 80 g, and most preferably 45 to 70 g, per liter of the developer. For example, in the case of sodium sulfite, the amount of sodium sulfite added is preferably not less than 63 g, and more preferably 63 to 126 g, per liter of developer.

The pH of the developer to be used in the present invention is 9.2 to 10, preferably 9.4 to 10, and particularly preferably 9.5 to 10.

The developer of the present invention is preferably used particularly as a developer for black-and-white light-sensitive materials and as the first developer (black-and-white developer) for color reversal light-sensitive materials.

In the developer to be used in the present invention, as well as the chelating agents of the present invention, various organic or inorganic chelating agents can be used in combination.

Inorganic chelating agents which can be used include sodium tetrapolyphosphate and sodium hexametaphosphate.

Organic chelating agents which can be used include organic carboxylic acids, aminopolycarboxylic acids, organic phosphonic acids, aminophosphonic acids and organic phosphonocarboxylic acids.

Organic carboxylic acids include acrylic acid, oxalic acid, malonic acid, succinic acid, glutaric acid, adipic acid, pyrophosphoric acid, cork acid, azelaic acid, sebacic acid, nonanedicarboxylic acid, decanedicarboxylic acid, undecanedicarboxylic acid, maleic acid, itaconic acid, malic acid, citric acid and tartaric acid. The present invention is not limited to the above compounds.

Aminopolycarboxylic acids include iminodiacetic acid, nitrilotriacetic acid, nitrilotripropionic acid, ethylenediaminemonohydroxyethyltriacetic acid, ethylenediaminetetraacetic acid, glycoletherdiaminetetraacetic acid, hydroxyethyliminodiacetic acid, 1,2-diaminopropanetetraacetic acid, and compounds described in Japanese Patent Application (OPI) No. 25632/77, 67747/80, 102624/82 and Japanese Patent Publication No. 4090/78.

Organic phosphonic acids include hydroxyalkylidenediphosphonic acids described in U.S. Pat. Nos. 3,214,454, 3,794,591 and West German patent DT-OS No. 2,227,639, and compounds described in *Research Disclosure,* 18170 (May, 1979).

Aminophosphonic acids include aminotri(methylenephosphonic acid), and compounds described in *Research Disclosure,* 18170 (May, 1979), and Japanese patent application (OPI) Nos. 208554/82, 61125/79, 29883/80 and 97347/81.

Organic phosphoncarboxylic acids include compounds described in Japanese patent application (OPI) Nos. 102726/77, 42730/78, 121127/79, 4024/80, 4025/80, 126241/80, 65955/80, 65956/80 and *Research Disclosure,* 18170 (May, 1979).

These chelating agents may be used in the form of alkali metal salts or ammonium salts.

As to the amount of the chelating agent to be used in combination, the total amount of the chelating agent of the present invention and the chelating agent to be used in combination is preferably $1\times10^{-3}$ to $1\times10^{-1}$ mol, more preferably $1\times10^{-3}$ to $2\times10^{-2}$ mol, per liter of the above developer.

As well as the above components, if desired, the developer to be used in the present invention may contain a buffer (e.g., carbonic acid salts, boric acid and boric acid salts), an alkali agent (e.g., hydroxides and carbonic acid salts), an auxiliary dissolving agent (e.g., polyethylene glycols and esters thereof), a pH adjustor (e.g., organic acids such as acetic acid), a development accelerator (e.g., various pyrimidium compounds as described in U.S. Pat. Nos. 2,648,604, 3,171,247 and Japanese patent publication No. 9503/69, other cationic compounds, cationic dyes such as phenolsaflan, neutral salts such as thallium nitrate and potassium nitrate, polyethylene glycol and derivatives thereof as described in Japanese patent publication No. 9304/69, U.S. Pat. Nos. 2,533,990, 2,531,832, 2,950,970, 2,577,127, nonionic compounds such as polythioethers, and organic solvents as described in Japanese patent publication No. 9509/69 and Belgian Pat. No. 682,862), a surface active agent, and so forth.

In addition, the developer may contain a dispersing agent for a silver colloid which is dissolved (e.g., mercapto compounds), and an antifoggant other than those of the present invention (e.g., halides such as potassium bromide and sodium bromide, organic antifoggants other than those described above, and other known antifoggants).

The developer of the present invention which contains the above components is usually used in the form of a chemical agent. That is, the developer of the present invention comprises several powdered chemical agents and/or liquid chemical agents. It is particularly preferred from the standpoint of ease of handling in preparation that the developer is used in the form of a liquid agent in combination with the dialdehyde-based hardening agent, the antifoggant, and further, if desired, the silver halide solvent of the present invention.

In the case where the developer of the present invention is used as a replenishing solution during processing by an automatic developing machine, a development initiator comprising a water-soluble halide and an acid agent is generally used. Incorporation in the development initiator of 5 to 500 mg/liter of the replenishing solution of thioether compounds described in Japanese patent application (OPI) No. 63530/82 is more preferred in that the sensitivity and gradation are well balanced from the beginning of the development.

The developing temperature and developing time are in relation to each other and are determined depending on the total processing time. In general, they are generally about 20° to 50° C. and 10 seconds to 3 minutes, respectively.

A fixing solution is an aqueous solution containing thiosulfuric acid salts and, if desired, further, water-soluble aluminum compounds, tartaric acid, citric acid, glutaric acid, boric acid and salts thereof. The pH of the fixing solution is preferably about 3.8 to 7.0 (20° C.). In the method of the present invention, a stopping step can be provided after development. In general, in a roller convey type automatic developing machine, the stopping step is omitted. Therefore, the developer is intermingled with the fixing solution, thereby increasing the pH of the fixing solution. In the case where the fixing solution contains aluminum compounds, the pH of the fixing solution is preferably adjusted to about 3.8 to 5.0 (20° C.) in order to maintain the reactivity of the fixing solution at a high level.

The fixing solution contains thiosulfuric acid ions provided by fixing agents such as ammonium thiosulfate and sodium thiosulfate as essential components. Ammonium thiosulfate is particularly preferred from the standpoint of fixing speed. The amount of the fixing agent used can be changed appropriately. In general, the amount of the fixing agent added is about 0.1 to 5 mol/liter of the fixing solution.

Water-soluble aluminum compounds acting mainly as a hardening agent in the fixing solution are compounds known as hardening agents of an acidic hardening fixing solution. Examples of the compounds are water-soluble salts such as aluminum chloride, aluminum sulfate and potash alum. The amount of the compound used is, as aluminum, preferably $1\times10^{-2}$ to $2\times10^{-1}$ mol per liter of the fixing solution.

Tartaric acid or derivatives thereof, citric acid or derivatives thereof can be used alone or in combination with each other. An effective amount of the compound used is at least 0.005 mol per liter of the fixing solution, and particularly 0.015 to 0.05 mol, per liter of the fixing solution.

The fixing solution can contain, if desired, a preservative (e.g., sulfite and bisulfite), a pH buffer (e.g., boric acid and boric acid salts), a pH adjustor (e.g., acetic acid), and a chelating agent (e.g., chelating agents as listed for the above developer).

The fixing temperature and fixing time are the same as in the case of development, and preferably are about 20° to 50° C. and 10 seconds to 3 minutes, respectively.

In accordance with the method of the present invention, the photographic material is washed with water and dried after the development and fixation. Washing with water is performed in order to substantially completely remove silver salts dissolved by fixation. It is preferred for washing to be carried out at about 20° to 50° C. for 10 seconds to 3 minutes. Drying is carried out at about 40° to 100° C. The drying time can be changed appropriately depending on ambient conditions. Usually, a sufficient drying time is about 5 seconds to 3.5 minutes.

The developer of the present invention is effective particularly when processing is carried out by use of an automatic developing machine.

Silver halide photographic materials to which the method of the present invention can be applied include a black-and-white photographic material (e.g., a negative film for cameras, a printing paper and a microfilm), and a color reversal light-sensitive material (e.g., a color reversal film and a color reversal printing paper). Preferably used is the general black-and-white negative light-sensitive material (particularly for cameras).

The light-sensitive material to be used in the present invention is preferably a light-sensitive material of low gradation and particularly preferably a material which provides a gradation (G) of 0.3 to 1.5.

The silver halide photographic material which can be used in the present invention comprises a support and at least one silver halide emulsion layer coated on the support. The silver halide emulsion layer may be coated not only on one side of the support but also on both sides of the support. If desired, a backing layer, an antihalation layer, an interlayer, the uppermost layer (e.g., a protective layer), and so on can be provided.

The silver halide emulsion is prepared by dispersing a silver halide such as silver chloride, silver iodide, silver bromide, silver chlorobromide, silver iodobromide and silver chloroiodobromide in a hydrophilic colloid (e.g., gelatin, modified gelatin, colloidal albumin, casein, carboxymethyl cellulose, hydroxyethyl cellulose, sodium alginate, polyvinyl alcohol, polyvinyl pyrrolidone and mixtures thereof). Of these silver halide emulsions, a silver iodobromide emulsion is particularly preferred in the practice of the present invention. More specifically, the silver halide emulsion is prepared by mixihg a water-soluble silver salt (e.g., silver nitrate) and a water-soluble halogen salt in the presence of water and a hydrophilic colloid using methods well-known in the art (e.g., the single jet method, the double jet method and the controlled jet method) and, thereafter, performing physical ripening and chemical sensitization such as gold sensitization and/or sulfur sensitization. In the emulsion thus obtained, tabular silver halide grains having a high aspect ratio as well as cubic, octahedral and spherical grains, as described in *Research Disclosure,* 22534 (January, 1983) can be used. In addition, these silver halide grains can be used in combination with internal latent image type silver halide grains described in Japanese patent publication No. 2068/66 and surface latent image type silver halide grains.

To the silver halide emulsion, during the process of preparation or just prior to coating, a spectral sensitizer (e.g., cyanine dyes, merocyanine dyes and mixtures thereof), a stabilizer (e.g., 4-hydroxy-6-methyl-1,3,3a,7-tetraazaindene), a sensitizer (e.g., compounds described in U.S. Pat. No. 3,619,198), an antifoggant (e.g., benzotriazole and 5-nitrobenzimidazole), a hardening agent (e.g., formalin, glyoxal, mucochloric acid and 2-hydroxy-4,6-dichloro-s-triazine), a coating aid (e.g., saponin, sodium lauryl sulfate, dodecylphenol polyethylene oxide ether and hexadecyltrimethylammonium bromide), and so forth can be added. The silver halide emulsion thus prepared is coated on a support such as a cellulose acetate film, and a polyethylene terephthalate film by known techniques such as the dip coating method, the air knife coating method, the bead coating method, the extrusion doctor coating method, and the both-side coating method, and then dried.

In the method of the present invention, photographic processing of an imagewise exposed black-and-white photographic material usually comprises the following steps:

(1) Black-and-white development→Fixing→Washing→Drying (2) Black-and-white development→Stopping→Fixing→Washing→Drying In the method of the present invention, photographic processing of an imagewise exposed color reversal photographic material usually comprises the following steps:

(3) First development (black-and-white development)→Reversal exposure→Color development→Blixing (or bleaching-fixing)→Washing→Drying The present invention is described in greater detail with reference to the following examples, although it is not intended to be limited thereto.

Unless otherwise indicated, all percents, ratios, etc., are by weight.

EXAMPLE 1

Potassium bromide, potassium iodide and silver nitrate were added to an aqueous gelatin solution while vigorously stirring to prepare a tabular silver iodobromide emulsion (AgI = 8 mol %) having an average grain diameter of 1.2 μm. Then, the emulsion thus-obtained was washed with water by the usual precipitation method and was subjected to chemical sensitization by gold sensitization and sulfur sensitization methods using chloroauric acid and sodium thiosulfate. As a stabilizer, 4-hydroxy-6-methyl-1,3,3a,7-tetraazaindene was added to obtain a silver iodobromide light-sensitive emulsion (Emulsion A). In the same manner as in the preparation of Emulsion A, except that the temperature was lowered, a tabular silver iodobromide emulsion having an average grain diameter of 0.6 μm was prepared. Then, in the same manner as in the preparation of emulsion A, chemical sensitizaton was performed and the stabilizer was added to obtain Emulsion B.

Using Emulsions a and B, the following layers were provided on a triacetyl cellulose support in the order indicated to prepared a light-sensitive material.

FIRST LAYER (EMULSION LAYER)

Emulsion B

| | |
|---|---|
| Binder: Gelatin | 8.5 g/m$^2$ |
| Amount of silver coated: | 3.9 g/m$^2$ |
| Coating aids: | |
| Sodium dodecylbenzenesulfonate | 0.1 mg/m$^2$ |
| Poly-p-styrenesulfonate potassium salt | 1 mg/m$^2$ |

SECOND LAYER (EMULSION LAYER)

Emulsion A

-continued

| | |
|---|---|
| Amount of silver coated: | 2.5 g/m$^2$ |
| Coating aids: | |
| Sodium dodecylbenzenesulfonate | 0.1 mg/m$^2$ |
| Poly-p-styrenesulfonate potassium salt | 0.8 mg/m$^2$ |
| Hardening agent: 2-Hydroxy-4,6-dichloro-s-triazine sodium salt | 0.025 mg/m$^2$ |

THIRD LAYER (SURFACE PROTECTIVE LAYER)

| | |
|---|---|
| Binder: Gelatin | 0.7 g/m$^2$ |
| Coating aid: N—Oleyl-N—methyltauryl sodium salt | 0.2 mg/m$^2$ |
| Matting agent: Polymethyl methacrylate fine grains (average grain diameter: 3 μm) | 0.13 mg/m$^2$ |

The light-sensitive material thus obtained was processed using various developers (1) to (8) shown in Table 1 and a fixing solution having the formulation shown below.

Fixing Solution

| | |
|---|---|
| Ammonium thiosulfate (anhydrous) | 200 g |
| Sodium sulfite (anhydrous) | 15 g |
| Acetic acid (28 wt % solution) | 55 ml |
| Boric acid | 7.5 g |
| Potash alum | 15 g |
| Water to make | 1,000 ml |

Automatic Developing Machine:
Kodak Versamat Film Processor Model 5AN
Processing Temperature:
Development, Fixing: 26.5° C.
Washing: Running water was used.
The results are shown in TAble 2.

TABLE 1

| Composition of Developer | Developer 1 | 2*4 | 3 | 4 | 5 | 6*4 | 7 | 8 |
|---|---|---|---|---|---|---|---|---|
| Sodium sulfite (g) | 80 | 80 | 80 | 80 | 80 | 80 | 80 | 80 |
| Chelating agent (EDTA or DTPA)*1 (g) | EDTA 1 | DTPA 1 | DTPA 1 | EDTA 1 | EDTA 1 | DTPA 1 | DTPA 1 | DTPA 1 |
| Borax.5$H_2O$ (g) | 15 | 15 | 15 | 15 | 15 | 15 | 15 | 15 |
| Cl—HQ or HQ*2 (g) | Cl—HQ 6 | Cl—HQ 6 | Cl—HQ 6 | HQ 3.5 | HQ 3.5 | HQ 3.5 | HQ 3.5 | HQ 3.5 |
| 3-Pyrazolidone (g) | 0.27 | 0.27 | 0.27 | 0.23 | 0.23 | 0.23 | 0.23 | 0.23 |
| Anhydrous sodium thiosulfate (g) | 0.60 | 0.60 | 0.60 | 0.60 | 0.60 | 0.60 | 0.60 | — |
| Sodium bromide (g) | 1.0 | 1.0 | 1.0 | 1.0 | 1.0 | 1.0 | 1.0 | 1.0 |
| Glutaraldehyde (g) | 7 | 7 | 7 | 7 | 7 | 7 | 7 | 7 |
| NI (0.015 g) or AQS (0.07 g)*3 | NI | NI | AQS | NI | AQS | NI | AQS | NI |
| Water to make 1 l | pH was adjusted to 9.70 with NaOH or $H_2SO_4$. | | | | | | | |

*1EDTA: Ethylenediaminetetraacetic acid
DTPA: Diethylenetriaminepentaacetic acid
*2Cl—HQ: Chlorohydroquinone
HQ: Hydroquinone
*3NI: 5-Nitroindazole
AQS: Sodium anthraquinone-β-sulfonate
*4Example of the present invention Binder: Gelatin 4.1 g/m$^2$

TABLE 2

| Photographic Characteristics | Developer 1 | 2*4 | 3 | 4 | 5 | 6*4 | 7 | 8 |
|---|---|---|---|---|---|---|---|---|
| Developing Time | | | | | | | | |

TABLE 2-continued

| Photographic Characteristics | Developer 1 | 2*4 | 3 | 4 | 5 | 6*4 | 7 | 8 |
|---|---|---|---|---|---|---|---|---|
| 1 minute Fog | 0.18 | 0.17 | 0.17 | 0.16 | 0.18 | 0.16 | 0.18 | 0.16 |
| 2 minutes Fog | 0.19 | 0.20 | 0.19 | 0.20 | 0.21 | 0.19 | 0.21 | 0.19 |
| 1 minute Sensitivity*1 | 98 | 99 | 100 | 102 | 101 | 101 | 100 | 92 |
| 2 minutes Sensitivity*1 | 405 | 405 | 400 | 435 | 440 | 440 | 430 | 380 |
| 1 minute Gradation (G)*3 | 0.49 | 0.49 | 0.51 | 0.50 | 0.49 | 0.51 | 0.49 | 0.58 |
| 2 minutes Gradation (G)*3 | 0.70 | 0.71 | 0.70 | 0.74 | 0.75 | 0.76 | 0.74 | 0.79 |
| Stability of Developer*2 | | | | | | | | |
| Amount of chlorohydroquinone of hydroquinone decreased (g) | 3.1 | 2.3 | 3.7 | 1.1 | 3.4 | 0.8 | 2.1 | 0.8 |
| pH | 9.75 | 9.72 | 9.78 | 9.68 | 9.78 | 9.68 | 9.74 | 9.68 |
| Amount of glutaraldehyde decreased (g) | 1.4 | 1.4 | 1.5 | 1.4 | 1.5 | 1.25 | 1.4 | 1.4 |

*1Relative sensitivity at log $E_{D=0.6}$
*2After being allowed to stand at 30° C. for 5 days
*3Gradation between D = 0.1 and a higher density point at log E
*4Example of the present invention The following are apparent from the results shown in Table 2.

(i) Photographic Characteristics

Fog:

Fog is reduced in the combination of hydroquinone and 5-nitroindazole more than in the combination of hydroquinone and sodium anthraquinone-β-sulfonate. (Compare Developer 6 and Developer 7.)

SENSITIVITY AND GRADATION

Hydroquinone is nearly equal to chlorohydroquinone in the 1 minute development. However, in the 2 minute development, hydroquinone increases sensitivity and gradation more than does chlorohydroquinone. That is, hydroquinone can produce the same photographic characteristics as does chlorohydroquinone in a shorter developing time than that of chlorohydroquinone. (Compare Developer 2 and Developer 6.)

In particular, the effect of shortening in time at the period of sensitization and development is increased in proportion to the total processing time from development to drying when the development is carried out by the use of an automatic developing machine. This is one of advantages of the present invention.

EFFECT OF SODIUM THIOSULFATE (SILVER HALIDE SOLVENT OF THE PRESENT INVENTION)

Developer 6 (containing sodium thiosulfate) produces effects of increasing the sensitivity at toe areas (increasing the relative sensitivity at log $E_{D=0.6}$) and of lowering the total gradation (decreasing the contrast) as compared with Developer 8 (not containing sodium thiosulfate). These characteristics are preferred in that very suitable latitude is exhibited over a wide exposure range and variable photographing can be attained.

(ii) Stability of Developer (i.e., amount of hydroquinones decreased, change in pH and amount of aldehyde decreased)

Diethylenetriaminepentaacetic acid (DTPA) increases the stability of hydroquinone more than does ethylenediaminetetraacetic acid (EDTA). (Compare Developer 1 and Developer 2, and also Developer 4 and Developer 6.)

5-Nitroindazole does not decrease the stability of hydroquinones more than does sodium anthraquinone-β-sulfonate. (Compare Developer 2 and Developer 3, also Developer 6 and Developer 7.)

Hydroquinone is more stable than chlorohydroquinone. (Compare Developer 2 and Developer 6.)

It can be seen from the above results that the combination of specified hydroquinone, antifoggant, and chelating agent is essential in the present invention.

EXAMPLE 2

Washing Properties

A film was developed at 26.5° C. for 1 minute with Developer 6 of Example 1 and Developer 9 obtained by removing glutaraldehyde only from Developer 6. In each developed film, the amount of the residual thiosulfuric acid salt was measured by the silver sulfide method described in Part 2 of ISO-417-1977.

In the film developed with Developer 6, $\Delta D_{blue}$ density was not more than 0.01, and in the film developed with Developer 9, $\Delta D_{blue}$ density was 0.08.

It is important from the viewpoint of stability of the silver image to wash out the components of the processing agent, particularly thiosulfuric acid salt from the light-sensitive material. It can be seen that if the development and hardening are carried out with glutaraldehyde in accordance with the present invention, the effect of washing out the thiosulfuric acid salt is increased.

EXAMPLE 3

Drying Properties

Twenty films (35 mm, 36 shots) were continuously processed with each of Developer 6 and Developer 9. With the processed film, drying properties were examined.

In the case of Developer 6, the film was withdrawn from the automatic developing machine in the condition that it was completely dried. In the case of Developer 9, the degree of drying was decreased with the advance of processing. The last film was withdrawn from the automatic developing machine in the condition that it was wet. Thus, it was impossible to store it in the superposed condition.

It can be seen from the above results that the hardening agent of the present invention is seential in the developer.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide photographic material which comprises developing an exposed silver halide photographic material with an alkaline black-and-white developer having a pH value of 9.2 to 10 comprising:

(1) at least one of hydroquinones;
(2) at least one of 3-pyrazolidone-based developing agents;
(3) at least one of dialdehyde-based hardening agents;
(4) at least one antifoggant selected from the group consisting essentially of an indazole-based antifoggant, a benzimidazole-based antifoggant, a benztriazole-based antifoggant and a mercaptothiadiazole-based antifoggant;
(5) at least one compound selected from the group consisting essentially of diethylenetriaminepentaacetic acid, triethylenetetraminehexaacetic acid, 1,3-diamino-2-propanol-tetraacetic acid, ethylenediaminetetramethylenephosphonic acid, aminotrimethylenephosphonic acid and alkali metal salts thereof;
(6) at least one silver halide solvent selected from the group consisting of thiosulfuric acid salts, ammonium salts, thiocyanic acid salts, organic amines, imdazole compounds and thioether compounds;
(7) at least one compound selected from the group consisting essentially of sulfite, bisulfite, and metabisulfite.

2. A method for processing a silver halide photographic material as in claim 1, wherein the alkaline black-and-white developer contains:

(1) at least one of the hydroquinones in an amount of 1 to 10 g per liter of the developer;
(2) at least one of the 3-pyrazolidone-based developing agents in an amount of 0.05 to 1 g per liter of the developer;
(3) at least one of the dialdehyde-based hardening agents in an amount of 1 to 50 g per liter of the developer;
(4) the antifoggant in an amount of 0.01 to 2 mmol per liter of the developer;
(5) the compound (5) in an amount of $0.5\times10^{-3}$ to $2\times10^{-2}$ mol per liter of the developer;
(6) at least one of silver halide solvents in an amount of 5 mg to 5 g per liter of the developer;
(7) the compound (7) in an amount of the total sulfite ion of not less than 40 g per liter of the developer.

3. A method for processing a silver halide photographic material as in claim 1, wherein the alkaline black-and-white developer has a pH value of 9.4 to 10.

4. A method for processing a silver halide photographic material as in claim 1, wherein the exposed silver halide photographic material is developed at a developing temperature of about 20° C. to about 50° C. and at a developing time of 10 seconds to 3 minutes.

5. A method for processing a silver halide photographic material as in claim 1, wherein the alkaline black-and-white developer contains:

(1) hydroquinone;
(2) at least one 3-pyrazolidone-based developing agent selected from 1-phenyl-3-pyrazolidone, 1-phenyl-4-methyl-4-hydroxymethyl-3-pyrazolidone and 1-phenyl-4,4-dihydroxymethyl-3-pyrazolidone;
(3) at least one dialdehyde-based hardening agent selected from glutaraldehyde and adducts of bisulfite thereof;
(4) at least one antifoggant selected from 5-nitroindazole, 5-nitrobenzimidazole and 5-nitrobenztriazole;
(5) at least one compound selected from diethylenetriaminepentaacetic acid, triethylenetetraminehexaacetic acid, ethylenediaminetetramethylenephosphonic acid and alkali metal salt thereof;
(6) at least one silver halide solvent selected from thiosulfuric acid salts, thioether compounds, and imidazole compounds;
(7) at least one compound selected from sulfite, bisulfite, and metabisulfite.

* * * * *